United States Patent [19]

Kasahara et al.

[11] Patent Number: 4,637,707

[45] Date of Patent: Jan. 20, 1987

[54] SUPPLEMENTARY DATA COPYING METHOD AND ORIGINAL PICTURE IMAGE RECORDER HAVING SUPPLEMENTARY DATA DISPLAY MEANS

[75] Inventors: Seitaro Kasahara; Akira Sawaki, both of Hachioji; Shun Kawata, Tokyo, all of Japan

[73] Assignee: Konishiroku Photo Industry Co., Ltd., Tokyo, Japan

[21] Appl. No.: 668,731

[22] Filed: Nov. 6, 1984

[30] Foreign Application Priority Data

| | | | |
|---|---|---|---|
| Dec. 28, 1983 | [JP] | Japan | 58-245243 |
| Dec. 28, 1983 | [JP] | Japan | 58-245244 |
| Dec. 28, 1983 | [JP] | Japan | 58-245245 |
| Dec. 28, 1983 | [JP] | Japan | 58-245246 |
| Dec. 28, 1983 | [JP] | Japan | 58-245247 |

[51] Int. Cl.[4] ..... G03G 15/00

[52] U.S. Cl. ..... 355/3 R; 355/7; 355/14 D; 355/14 E; 355/77

[58] Field of Search ..... 355/3 R, 5, 7, 11, 75, 355/77, 14 DD, 3 DD, 14 E

[56] References Cited

U.S. PATENT DOCUMENTS

| | | | |
|---|---|---|---|
| 3,642,370 | 2/1972 | Meredith et al. | 355/75 |
| 3,775,007 | 11/1973 | Davidson | 355/75 X |
| 4,386,836 | 6/1983 | Aoki et al. | 355/3 R |
| 4,447,148 | 5/1984 | Hatzis | 355/3 R |

*Primary Examiner*—R. L. Moses

*Attorney, Agent, or Firm*—Jordan B. Bierman

[57] ABSTRACT

An original picture image recorder and method wherein a supplementary data display device for displaying supplemental data being copied in addition to original data is provided close to a document glass plate on which documents being recorded are mounted, and a device for preventing the background area of the display device in a display state from generating photographic fog on materials being recorded is provided. A light source for illuminating the display device as one for preventing photographic fog is provided separately from an exposure device for exposing the display device.

9 Claims, 41 Drawing Figures

| | FIRST ORDER | | | | | | | | | |
|---|---|---|---|---|---|---|---|---|---|---|
| | 0 | 1 | 2 | 3 | 4 | 5 | 6 | 7 | 8 | 9 |
| TENTH ORDER | | | | | | | | | | |
| 0 | ア | カ | サ | タ | ナ | ハ | マ | ヤ | ラ | ワ |
| 1 | イ | キ | シ | チ | ニ | ヒ | ミ | ゛ | リ | ゜ |
| 2 | ウ | ク | ス | ツ | ヌ | フ | ム | ユ | ル | ン |
| 3 | エ | ケ | セ | テ | ネ | ヘ | メ | ° | レ | 。 |
| 4 | オ | コ | ソ | ト | ノ | ホ | モ | ヨ | ロ | ヲ |
| 5 | ァ | ィ | ゥ | ェ | ォ | ッ | ャ | ュ | ヮ | ー |
| 6 | ‘ | ． | ： | ； | ／ | ＊ | ＋ | ， | ； | ！ |
| 7 | ＃ | ＄ | ％ | ＆ | ＊ | ＠ | ， | ＝ | ： | ？ |
| 8 | （ | ） | ［ | ］ | ＜ | ＞ | ［ | ］ | ＜ | |
| 9 | 0 | 1 | 2 | 3 | 4 | 5 | 6 | 7 | 8 | 9 |

| | FIRST ORDER | | | | | | | | | |
|---|---|---|---|---|---|---|---|---|---|---|
| | 0 | 1 | 2 | 3 | 4 | 5 | 6 | 7 | 8 | 9 |
| TENTH ORDER | | | | | | | | | | |
| 0 | A | B | C | D | E | F | G | H | I | J |
| 1 | K | L | M | N | O | P | Q | R | S | T |
| 2 | U | V | W | X | Y | Z | | | | |
| 3 | a | b | c | d | e | f | g | h | i | j |
| 4 | k | l | m | n | o | p | q | r | s | t |
| 5 | u | v | w | x | y | z | | | | |
| 6 | ' | . | : | ; | / | * | + | - | = | ! |
| 7 | # | $ | % | & | ¥ | @ | ' | " | < | ? |
| 8 | ( | ) | ｢ | ｣ | ＜ | ＞ | ｢ | ｣ | | |
| 9 | 0 | 1 | 2 | 3 | 4 | 5 | 6 | 7 | 8 | 9 |

SUPPLEMENTARY DATA COPYING METHOD AND ORIGINAL PICTURE IMAGE RECORDER HAVING SUPPLEMENTARY DATA DISPLAY MEANS

BACKGROUND OF THE INVENTION

1. Field of the Invention

This invention relates to a supplementary data copying method and recorder, and particularly to a supplementary data recorder capable of recording such as rate and time, for instance, together with a document picture image.

2. Description of the Prior Art

A common practice, occurring almost daily in offices and factories, is to make copies of a document and distribute them to departments and to concerned persons. These copies are normally supplied with date and time of distribution, originator, addressee and similar data.

Additional data entered on these copies also include, ID number, destination, as well as the aforementioned date, time, originator and, when excerpts of news papers and magazines are copied, sources of articles and also serial numbers when multiple copies are produced.

However, it is extremely troublesome to enter such additional data on documents and, when there are a plurality of documents to be copied, it is not only a troublesome task but also an error-prone process.

To remedy such shortcomings, there have been proposed methods of providing printers for printing such additional data on copy picture images such as providing platen glass and document retaining drums with liquid crystal stations to display the contents of the liquid crystal stations on the copy picture images. However, these arrangements have disadvantages in that they tend to be large and expensive and, since the density of the background of the liquid crystal station is higher than that of the document, those with liquid crystal stations allow the portions corresponding to the liquid crystal stations to generate photographic fog, because there is a difference in the density of background between the portions in a copy picture image corresponding to the original picture image and the display station.

SUMMARY OF THE INVENTION

An object of the present invention which has been made to eliminate drawbacks inherent in conventional apparatus is to provide a compact inexpensive supplementary data copying method and original picture image recorder having supplementary data display means capable of allowing supplementary data together with originals to be copied when the originals are copied in order to eliminate the troublesome task of entering supplementary data on the original.

In the additional data recorder according to the present invention for recording supplementary data such as a data when original data is copied, there is arranged a supplementary data display station close to the portion where an original document is mounted, so that spot exposure is given to the display station when the original is exposed to light.

In another embodiment of the present invention, the copying machine having a supplementary data recording means for recording supplementary data such as a data when an original data is copied, is provided with an additional data display station close to the portion where an original document is mounted, so that the conditions for forming picture images of the image forming means may be changed when the original or additional data is copied.

In still another embodiment of the present invention, a copying machine having an additional data recording means for recording supplementary data together with original data is provided with an additional data display station which is composed of liquid crystal and an unwanted charge exposure device for preventing photographic fog from being generated, at least in the display station.

In still another embodiment of the present invention, the supplementary data recorder for recording data such as a data when the original data is copied is provided with a supplementary data display station on the undersurface of a scale plate provided on the plate where the original data is mounted, the display station being composed of liquid crystal and the surface of the scale plate opposite to the display station being given color coinciding with white or with the sensitivity characteristics of an image retainer.

In still another embodiment of the present invention, a supplementary data recorder for recording such data as a date when the original data is copied is provided with a supplementary data display station arranged on the undersurface of the scale plate provided on the plate where the original data is mounted, the display station being composed of electroluminescence and transmissive liquid crystal.

In still another embodiment of the present invention, a supplementary data recorder for recording supplementary and original data is provided on the undersurface of the scale plate for the plate where the document is mounted, so that paper feeding timing may be varied according to the contents of the additional data in such a way that the additional data is recorded.

In still another embodiment of the present invention, the supplementary data recorder for recording additional and original data is arranged on the undersurface of the scale plate of the plate where the document is mounted, whereby paper feeding timing is accelerated in the supplementary data recording mode.

In still another embodiment of the present invention, a copying machine capable of allowing supplementary and original data to be simultaneously recorded is so controlled as to reduce the size of the copy when supplementary data is recorded.

Other objects and features of the present invention will be made clear by reference to the following drawings.

BRIEF DESCRIPTION OF THE DRAWINGS

FIGS. 9(*a*), 9(*b*), 9(*c*), 9(*d*) are charts of input conditions and cursor movements.

DESCRIPTION OF THE PREFERRED EMBODIMENTS

Figure 1:
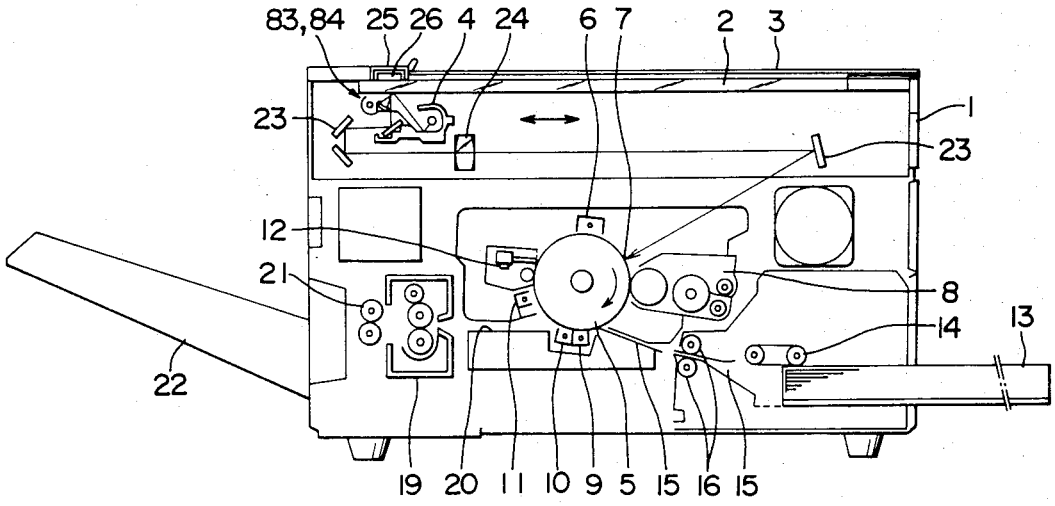
FIG. 1 is a side view of an electrophotographic reproducing apparatus.

Referring now to the drawings, the preferred embodiments of the present invention will be described.

FIG. 1 is a schematic layout drawing of an electrophotographic copying machine wherein a document glass plate 2 is mounted on the surface of the body 1, and a platen cover 3 capable of uncovering and covering the surface of the document glass plate 2 is provided.

In the body 1 are provided an exposure device 4 having an exposure lamp 80 for radiating light to the undersurface of the document glass plate 2 in the upper porticn therecf; groups of reflecting mirrors 23 and lenses 34 for transmitting the light radiated from the exposure lamp 80 and reflected from the document to an exposure assembly 7; a photosensitive drum 5 as an image retainer rotatably installed in the central portion thereof; a charging device 6 opposite and upwardly close to the photosensitive drum 5; and the exposure assembly 7, a developing device 8, a transfer device 9, a separating device 10, a charge eliminating device 11 and a cleaning device 12 each arranged close to the photosensitive drum 5 is that order clockwise in the direction of rotation.

Figure 11:
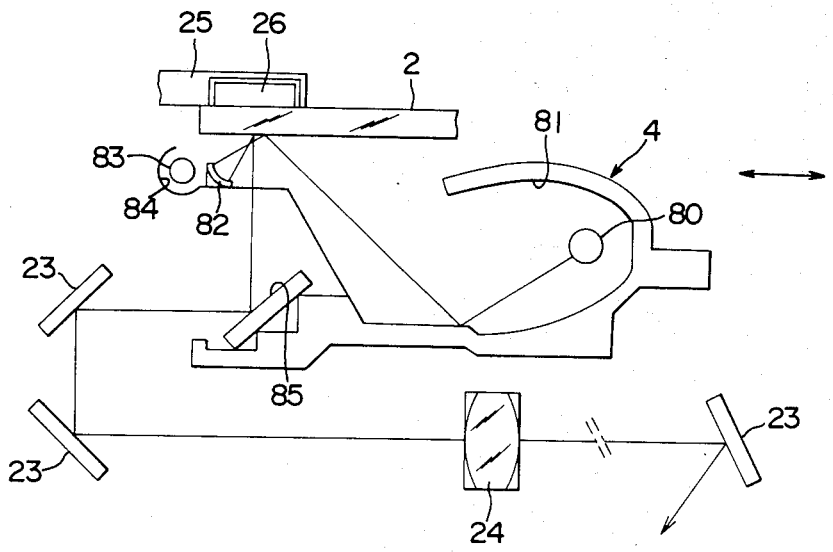
FIG. 11 is an enlarged view of the principal mechanism.

As shown in FIG. 11, the exposure device 4 covers the exposure lamp 80 with a main reflecting mirror 81 and a predetermined space therebetween. Part of the main reflecting mirror 81 is made open and there is arranged an auxiliary reflecting mirror 82 for transmitting the light from the exposure lamp which has reached the document glass plate 2 and has been reflected therefrom to the document glass plate 2 again. A spot reflecting mirror 84 and a spot exposure lamp 83 are installed close to the auxiliary reflecting mirror 82.

A reflecting mirror 85 transmits the reflected light to the group of lenses 24. The exposure device 4 is made to reciprocally horizontally (in direction of arrow) move in company with the group of lenses 24.

A cassette case 13 is provided on one side of the lower portion inside the body 1, the cassette case being insertable therein. A paper feeding roller 14 is so positioned that it is allowed to contact the uppermost piece of paper out of those stacked in the cassette case 13 when inserted and a paper feeding passage 15 through which the paper within the cassette case 13 is carried to the transfer device 9 is provided close to and in between both the paper feeding roller 14 and the transfer device 9.

Guide plates constituting the paper feeding passage 15 are partially cut out and this portion is provided with a pair of resist rollers 16 in the vertical direction.

On the other side of the lower portion inside the body 1 is installed a fixing device 19, whereby a paper carrying passage 20 is provided in between the fixing device 19 and the separating device 10 installed close to the photosensitive drum 5, whereas a paper discharging assembly 21 is positioned opposite to the paper carrying passage 20 of the fixing device, a paper discharging tray 22 being installed outside the discharging assembly 21.

A scale plate 25 is mounted on the leftmost surface of the document glass plate 2 of the electrophotographic copying machine thus constructed and a liquid crystal display station 26 for a supplementary data recorder is arranged between the under surface of the scale plate 25 and the surface of the document glass plate 2.

Figure 2:
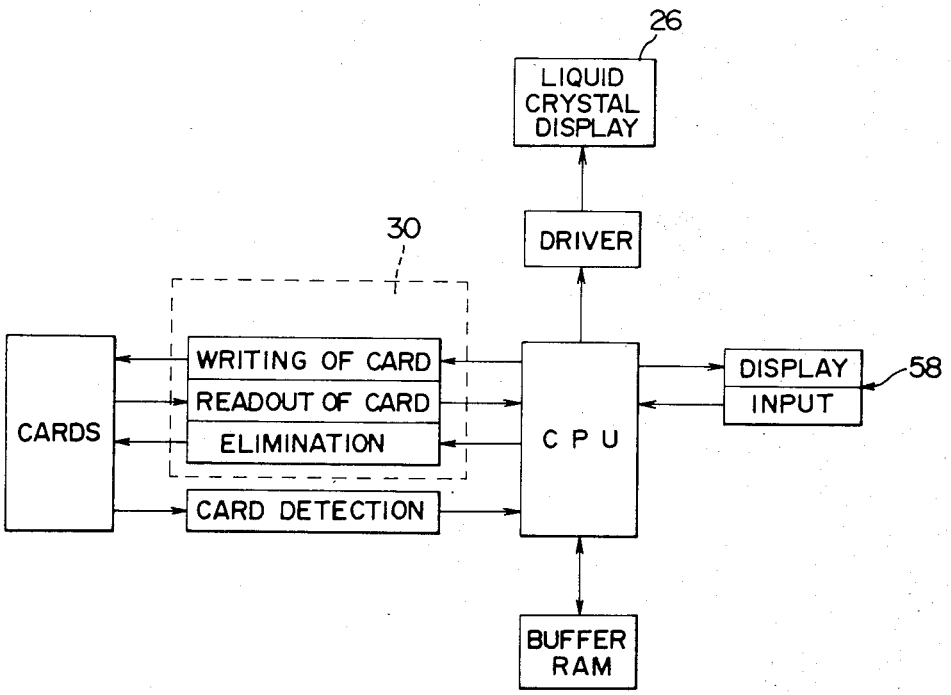
FIG. 2 is a block diagram thereof.
Figure 3:
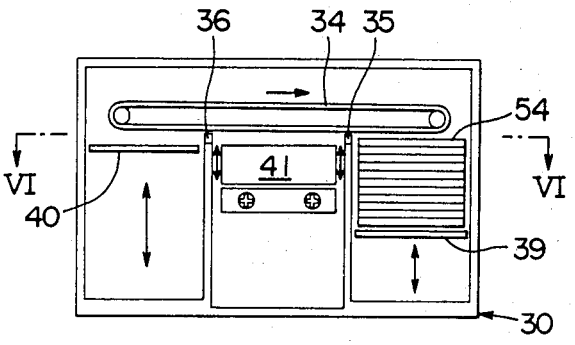
FIG. 3 is a front view of a card reader.
Figure 4:
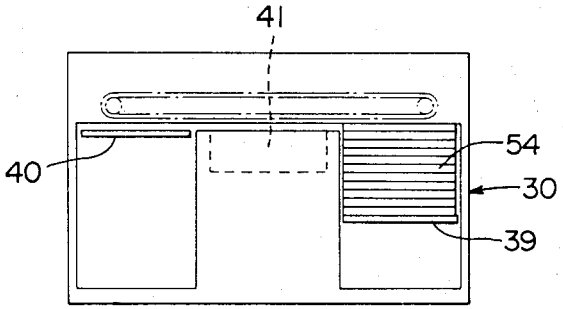
FIG. 4 is a view of the card reader partially covered, shown in FIG. 3.
Figure 5:
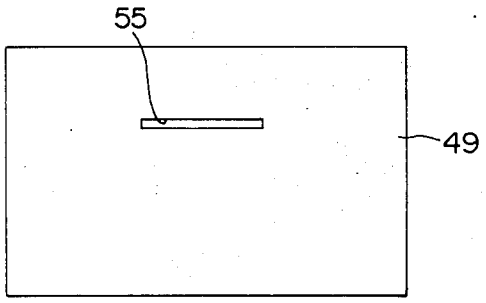
FIG. 5 is a view thereof with the door being shut.
Figure 6:
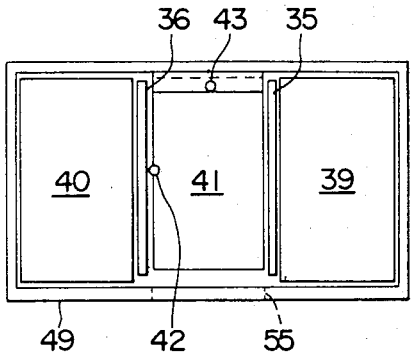
FIG. 6 is a view of the card reader taken along line VI—VI of FIG. 3.

As shown in FIG. 2, the liquid crystal display station 26 is connected with the central processing unit (CPU) and an operating panel 58 of the electrophotographic copying machine is connected to the CPU to provide copying conditions and make the liquid crystal display station 26 effect display through the CPU.

An original is first mounted on the surface of the document glass plate 2 to obtain a copy image using the electrophotographic copying machine thus constructed as above described. In this case, an edge of the original is caused to contact the scale plate 25 to suitably place the original in position and cover it with the platen cover 3 before the panel 58 is operated.

Figures 7, 8:
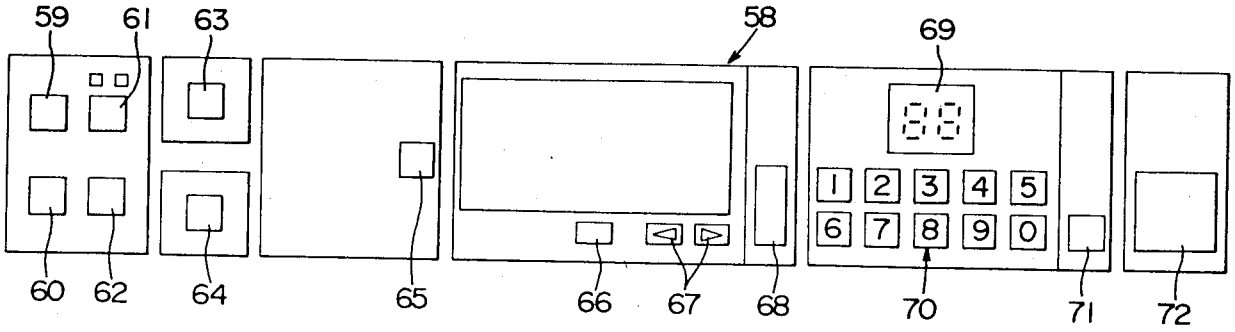
FIG. 7 is the operating panel.
FIG. 8 is a table of katakana codes.

The operating panel 58 is so arranged as shown in FIG. 7 that, if the number of copies is selected with the ten-key pad 70, the selected number of sheets will be displayed on an LED 69. Moreover, if an automode key 68 is pressed, it will operate a mechanism (APS) for detecting the original size and automatically determining the size of paper to be fed and another (EE mechanism) for automatically detecting the density of the original and setting that of a copy. There are also installed a cassette selection key 66 and a density setting key 67 which allow the operations described above to be effected manually.

The arrangement also includes a magnification setting key 65 for varying the size of the copying image, a sorter selection key 64, an actuator key 63 for actuating the automated original feeding mechanism, a copy start key 72 and a stop clear key 71.

A plurality of other keys are added to the operating panel 58, including a character input key 59, a set key 60, a mode switching key 61 and a print key 62.

The copying operation is started when the copy start key 72 is turned on after the ten-key pad 70 and the automode key 68 are turned on, whereby the photosensitive drum 5 starts to rotate, also starting the charging device for charging the periphery of the drum 5 with electricity. At the same time, the paper feeding roller 14 starts rotating and causes the uppermost sheet of paper among those contained in the cassette case 13 to be carried into the paper feeding passage 15. When that paper reaches the resist roller 16, it is detected by a detector member such as a microswitch (not shown) and forced to stop at that position. When the paper reaches the resist roller 16, the exposure lamp 80 of the exposure device 4 simultaneously lights, illuminating the undersurface of the document glass plate 2, whereby the exposure optical system comprising the exposure device 4 and the group of lenses starts to move and causes an electrostatic latent image corresponding to the original image to be formed on the peripheral surface of the photosensitive drum 5.

Then the electrostatic image is developed by the developing device 8 to become a toner image as the photosensitive drum 5 rotates and is brought to the position opposite to the transfer device 9.

Since the paper is carried within the paper feeding passage 15 when the resist roller 16 is started and brought to the position opposite to the transfer device 9, the toner image on the peripheral surface of the photosensitive drum 5 is transferred to the paper by the transfer device 9, subjected to separation by the separating device 10, carried to the fixing device 19 through the carrying passage 20 where the paper is fixed before being discharged onto the paper discharge tray 22.

The photosensitive drum 5 is cleaned by the charge eliminating device 11 and the cleaning device 12 to terminate its one-cycle operation, whereat the photosensitive drum 5 and the charging device 6 both stop.

The operation described above is repeated, once for each sheet of paper.

In the electrophotographic copying machine thus operating, various supplementary data are entered in a copy image in the following manner.

The print key 62 on the operating panel 58, if pressed, will bring the CPU to such a state as to enter supplementary data in the copy image; that is, allow the display station 26 to display data.

The print key 62, if pressed, will bring about the reduced size mode so that supplementary data is entered in part of the copy image. The ideal reduction should be 2%, whereby the reproduction will be ×0.98. Such a reduction will allow additional data not to be largely different from the original in size and will secure a space large enough for data to be entered.

If a reduction factor of 2% is introduced, for instance, ×1.0, ×0.81, ×0.71 and ×1.24 will become ×0.98, ×0.79, ×0.69 and ×1.22, respectively. A pulse motor is used to tune the group of lenses 24 to the reduced size and the motor can be controlled by the number of pulses given by a home position sensor (for instance ×1.0) installed.

Other than the method of automatically scaling down the magnification as mentioned above, there is also an effective one wherein paper feed timing is accelerated by increasing the speed of the resist roller 16 when the print key 62 is pressed, provided that the transfer paper is larger than the original.

The character input key 59 is then turned on and off after the print key 62 on the operating panel 58 is turned on to select supplementary data from the key on the operating panel 58 to be displayed in the display station 26, or a display in the display station 26 with a card recording the supplementary data described later.

Accordingly, if the character input key 59 is turned on, the character input mode is selected and, since the character input mode is divided into the katakana mode and alphabet mode, the katakana mode, for isntance, is selected by the mode switching key 61. The following input method is employed in the Katakana mode.

The ten-keys 70 are first used to select a character with the table in FIG. 8. For instance, if 4, 2 are input with from the ten-keys 70, numerals 4, 2 are displayed on the LED 69 for displaying the set number of sheets and, if the set key 60 is then pressed, the character in grid square 4, 2, that is, katakana 「ソ」 will be input and displayed in the display station 26 (FIG. 9(*a*)). Subsequently, combinations of numerals 2, 0 for 「ヴ」 (FIG. 9(*b*)), numerals 2, 6 for 「ム」 (FIG. 9(*c*)) and numerals 0, 1 for 「力」 (FIG. 9(*d*)) are input and displayed in the display station 26 each by turning on the set key 60 in the same manner.

A cursor 75 is in the lower stage of the display station 26 before the set key 60 is turned on and, if the cursor 75 is positioned in the upper stage of the display station 26, a display corresponding to the input will be given to the upper stage thereof. Moreover, a stop clear key 71 must be turned on to erase the character positioned in the upper stage where the cursor 75 has been posi- tioned.

Although the cursor 75 is to be moved back and forth one place each time the set key 60 is pressed after a grid square has been designated by inputting a combination of two numerals as mentioned above, it can be moved in the direction of the arrow indicated on each of the density setting keys 67 by pressing one of the density setting keys 67 when a blank is desired.

Also, when the katakana mode is switched over to the alphabet mode, such alteration may be effected by turning on the mode switching key 61.

Figures 9A, 9B, 9C, 9D, 10:
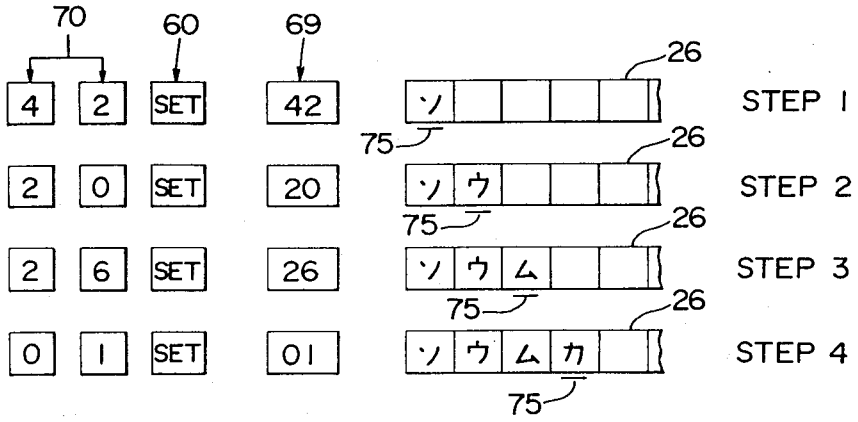
FIG. 10 is a table of alphabet codes.

An alphabet can also be input according to the address indicated in a table of addresses of FIG. 10 for the alphabet mode in the same manner as in the case of the katakana mode.

In this case, numerals and symbols defined by the grid squares common to the katakana and alphabet modes are employed to make it easier to handle them.

Figure 12:
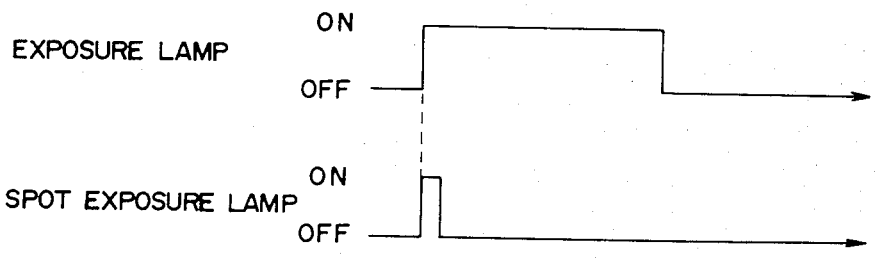
FIG. 12 is a chart of illuminaticn timing for exposure and spot exposure lamps.

Any display may be made in the display station 26 by the operation just described and, since the spot exposure lamp 83 for effecting exposure to the display station 26 only is installed with an exposure device 4, a sufficient quantity of light radiated to the display station 26 may be secured. Consequently, no photographic fog will be generated in the portion where the contents of the display station 26 out of the copy image have been recorded even if the density on the display unit 26 is greater than that of the original. FIG. 12 shows the relation between the illuminating timing of the spot exposure lamp 83 and that of the exposure lamp 80. Although the spot exposure lamp 83 also lights when the exposure lamp 80 lights, since the exposure optical system simultaneously starts to move to the right of FIG. 1, the spot exposure lamp 83 ceases to light immediately after it has passed through the illuminated area in the display station 26 to prevent various bad effects caused by difference in the degree of exposure within the image of the original.

Electrostatic latent images corresponding to the display station 26 and the original are formed on the photosensitive drum 5 by the exposure lamp 80 within the exposure device 4 and the spot exposure lamp 83 and made into toner images by the developing device 8. While the images pass through the transferring and separating areas, the copy image and the contents of the display station 26, that is, additional data, are recorded on a copy being made.

In other words, if the copying operation is started by the copy start key 72 after a display has been given to the display station 26 according to the operation just described, electrostatic latent images corresponding to the display station 26 and the original data are formed on the photosensitive drum 5 at the time of exposure and then made into toner images in the developing device 8. While the images pass through the transferring and separating areas, the copy image and the contents of the display station 26, that is, additional data, are recorded on a copy being made.

In this case, the exposure device 4 is so controlled by the CPU as to illuminate the liquid crystal display station 26 by amplifying the quantity of exposure when it starts outward movement, that is, illuminating the display station 26 to obtain a clear copy image on the liquid crystal display station 26 by preventing photographic fog caused by the background of the liquid crystal display station 26 and the clear, sufficiently dense copy image of the original data by reducing the quantity of exposure up to what is used to illuminate only the original data when the latter is illuminated. Also, it is possible to prevent the generation of unevenness between the copy image corresponding to the display station and that corresponding to the original image.

A copy image free from unevenness is always available because the degree of exposure from the exposure device 4 can be changed freely according to the density of the liquid crystal substance in the display station 26. In other words, a clear copy image is obtainable by changing the conditions of the exposure device 4 as a means for forming an image, that is, the degree of exposure.

Figure 13:
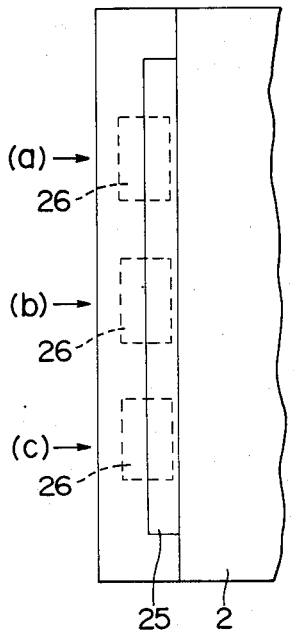
FIG. 13 shows the relative positions of the glass plate, scale plate and display station.
Figure 14A:
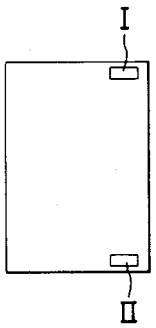
FIGS. 14(*a*), 14(*b*), 14(*c*) are views of the positions of the additional data in a copy picture image.
Figure 14B:
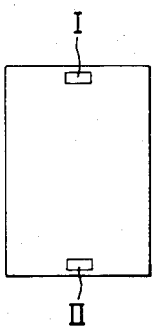
Figure 14C:
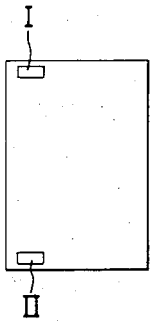

If additional data in the copy image of a copy being made is positioned against the scale plate 25 at (a), (b) and (c) of FIG. 13, it will appear as shown in FIGS. 14(*a*), 14(*b*) or 14(*c*), respectively.

In this case, the supplementary data will appear at position I when the front end of the original is made to contact scale plate 25 and at position II when its rear end is made to contact scale plate 25. In case the supplementary data relates to an addressee, position I in FIG. 14(*c*) will be relevant and in case it relates to an addressor with date, position I in FIG. 14(*a*) will be relevant and in case it relates to a page, the position II in FIG. 14(*b*) will be relevant. When the display station 26 is positioned at (b) of FIG. 13, it is applicable to originals of all sizes.

Since the degree of exposure of the spot exposure lamp 83 is variable, it may be adjusted depending on the display station arranged.

When a display is made in the display station 26 according to a card storing additional data, the character input key 59 is first put in the OFF state. As a result, the print key 62 remains ON, so that the card is ready to be read out.

By mounting several cards on the tray of a card reader 30 shown in FIGS. 3~6, it is possible to display the contents stored therein in the display station 26. In other words, if the cards 54 are mounted on the tray 39 and the door 49 is shut, both the trays 39, 40 will be elevated by a drive member (not shown), which stops because of the operation of a sensing member (not shown) when the surface of the batch of cards on the tray 39 comes in contact with the under surface of a carrier belt 34, whereas the other tray 40 stops at the position lower than that of the tray 39 by one card.

If the copy start key 72 is pressed, a moving stopper 35 will be lowered and simultaneously the carrier belt 34 will be started to carry the cards on the tray 39. Since the moving stopper 36 is arranged to project slightly, the carried cards contact the moving stopper 36, whereby the sensing member 42 detects that the cards have reached the upper portion of a readout member 41, causing the carrier belt 34 to stop and preventing the next card from being carried as a moving stopper 35 rises. The contents stored in the card are read by the CPU through the readout member 41 and then displayed in the display station 26 through a driver, whereby the contents in the display station together with the original image are recorded.

When the uppermost card has been processed, the moving stopper 36 is lowered and the carrier belt moves to the upper portion of the tray 40. The tray 39 is raised by the thickness of one card, whereas the tray 40 is lowered by the thickness of one card. The next card is then moved by the carrier belt 34 and positioned in the upper portion of the readout member 41. When the carrier belt 34 finishes feeding the last card, the tray 39 is lowered and returned up to the initial position and the tray 40 is also lowered and returned to the initial position when the last card is completely discharged.

When only one card is used, if the card is inserted into the card inlet 55 made in the door 49 of the card reader 30, the card will be positioned above the surface of the readout member 41 and, since there is installed a detection member 43 in the inner part in the direction of insertion, the carrier belt 34 will position the card on the tray 40 by means of the drive member.

When cards are used in this manner, a copy image with the original and supplementary data may be obtained.

Since a RAM buffer is connected to the CPU, the contents of the display station 26 may be registered on the card through the card reader 30, also used as a writing device.

In the embodiment just described, references have been made to the reduced size mode for copying not only the contents of the display station but also the original image, and to the variable the paper feeding timing. However, the present invention is not limited to the use of such a mode and such timing but also ensures that the contents of the display station may be recorded if the display station is allowed to appear in the position corresponding to the end of the original.

Also, a transmissive liquid crystal display station may be used to provide an exposure portion on the rear surface and, needless to say, an ECD (electrochromic display) in place of the liquid crystal display station and the like is also usable.

The present invention thus makes it possible to obtain a clear copy image with the contents of the display station being free from photogrpahic fog and, even if the density of the display station changes, effectively maintain a copy image of good quality because the degree of spot exposure may be varied.

In the embodiment just described, photographic fog is prevented from occurring in the copy image of the supplementary data by increasing the degree of exposure when the exposure device 4 exposes the display station 26 to light as compared with the time the original data is exposed. However, it is not limited to the above arrangement and an excellent image with the copy image of supplementary data being free from photographic fog and that of the original being provided with sufficient density is obtainable by increasing the developing bias as the image forming condition of the developing device 8 as another image forming means when the electrostatic latent image corresponding to the display station 26 is developed and decreasing the developing bias when the portion of the electrostatic latent image corresponding to the original data therefrom is developed. Moreover, if the developing bias is reduced at a uniform rate, it will be able to prevent photogrpahic fog from being generated in the copy image.

Further, a transmissive liquid crystal station may be employed to provide an exposure station on the rear surface, and an ECD (electrochromic display) in place of the liquid crystal station may also be used.

The aforementioned embodiment offers excellent effects including obtaining a clear copy image because no photographic fog caused by the difference in image density between the contents of a record in the display station and original data occurs, and because it always maintains the superior quality of the copy image, because of the degree of exposure of the exposure device and the developing bias of the developing device can be varied even when the density of the display station changes.

Figure 15:
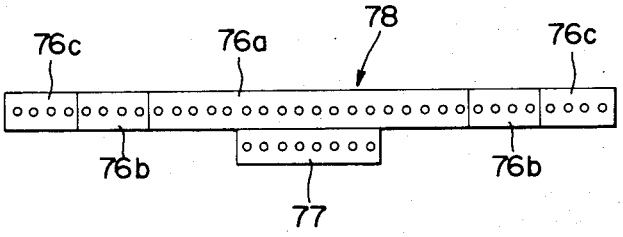
FIG. 15 is an unwanted charge exposure device.

In another embodiment of the present invention, an unwanted charge exposure device 78 shown in FIG. 15 is installed ahead or in the rear of the exposure assembly 7 in the direction of rotation of the photosensitive drum 5 and on this side of the developing device 8, the unwanted charge exposure device 78 comprising an unwanted charge eliminating lamp 76 and a lamp 77 for preventing photographic fogging of the additional data, the unwanted charge eliminating lamp 76 comprising a yellow LED array, first irradiating parts **76*b* being respectively coupled to both sides of its central irradiating part 76*a* and second irradiating parts 76*c* being respectively coupled to both the irradiating parts 76*b* on their external sides. Moreover, a lamp 77 for preventing photographic fogging of the additional data corresponding to the display station 26 and comprising a green LED array is arranged close to the central irradiating part 76*a***.

The unwanted charge eliminating lamp 76 of the unwanted charge exposure device 76 is arranged between the exposure assembly 7 and the developing device 8. The central irradiating part **76*a* and the first and second irradiating parts 76*b*, 76*c* constituting the unwanted charge eliminating lamp 76** light and cease to light depending on whether copy is enlarged or reduced so as to eliminate the unwanted charge in those other than the effective image region.

After display has been made in the display station 26 through the above operation, the copy start key 72 is pressed to start the copying operation. An electrostatic latent image corresponding to the contents displayed in the display station 26 and the original data is thus formed on the photosensitive drum 5 and, when the image reaches the position opposite the unwanted charge exposure device 78 as the photosensitive drum 5 rotates, the group of LED in the unwanted charge eliminating lamp 76 lights and ceases to light as described above to eliminate the unwanted charge. The lamp 77 for preventing photographic fogging of the supplemental data close to the central irradiating part **76*a* operates to irradiate the portion of the electrostatic latent image corresponding to the display station 26**.

In this case, the timing where the lamp 77 for preventing photographic fogging of the supplemental data is so controlled by the CPU that the lamp irradiates only the portion of the electrostatic latent image corresponding to the display station 26. Accordingly, unwanted charges of those other than the electrostatic latent image corresponding to the original data are eliminated by the unwanted charge eliminating lamp 76 and the portion corresponding to the display station out of that of the electrostatic latent image corresponding to the original data, that is, the portion of the supplementary data is irradiated by the lamp 77 to prevent photographic fogging of the supplemental data. Since yellow LEDs are used for the unwanted charge eliminating lamp 76 and green LEDs are used for the lamp preventing photographic fogging of the supplemental data, the intensity of illumination of the lamp 77 for preventing photographic fogging of the supplemental data is lower than that of the unwanted charge eliminating lamp 76; consequently, the charge in the portion having the ground color of liquid crystal may be eliminated without eliminating the whole electrostatic latent image corresponding to the display station 26, so that photographic fog in the portion of the supplementary data of the copy image may be prevented from occurring. This results in a clear copy image with original and supplementary data being recorded therein.

Figure 16:
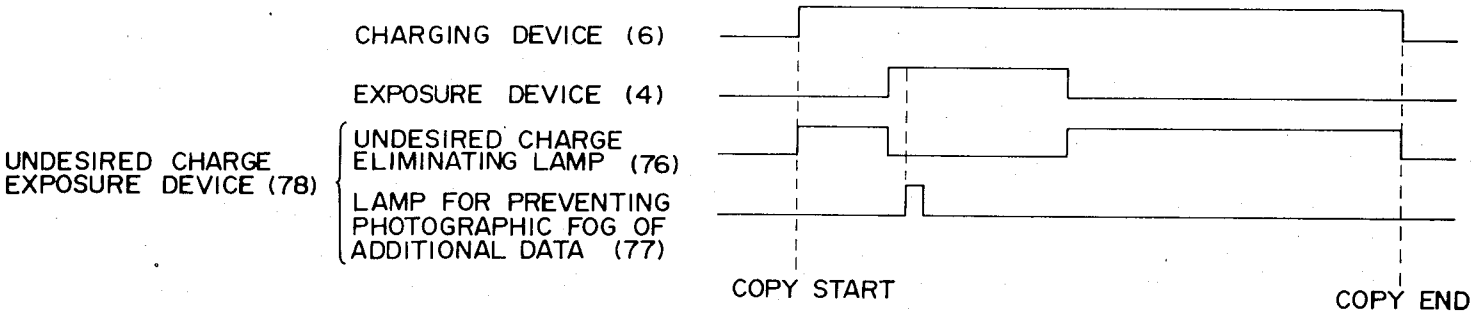
FIG. 16 shows the operating timing for charging, exposure and unwanted charge exposure devices.

FIG. 16 shows operating timing for the unwanted charge eliminating lamp 76 of the unwanted charge exposure device 78, the lamp 77 for preventing photographic fogging of the supplementary data, the charging device 6 and the exposure deivce 4, the reduction ratio in this case being determined by the degree of magnification. When the portions where the electrostatic latent images in those other than the effective image region are formed are positioned opposite to each other, all parts **76*a*, 76*b*, 76*c* of the undesired charge eliminating lamp 76 light so as to eliminate the undesired charge, whereas when the electrostatic latent images in the effective image region are positioned opposite to each other, those parts cease to light. On the other hand, the lamp 77 for preventing photographic fogging of the additional data is so controlled as to light only when the portions of the electrostatic latent images by means of the display station 26** are positioned opposite to each other.

Even when the supplementary data and the original data are copied together in this embodiment, photographic fog is prevented from being generated in the image portion corresponding to the additional data and a copy image of superior quality can effectively be obtained.

Figure 17:
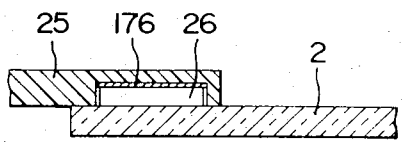

In another embodiment of the present invention, the display station 26 is, as shown in FIG. 17, formed with the transmissive liquid crystal positioned above the surface of the document glass plate 2 and the undersurface of the scale plate 25 facing the display station 26 is coated with white paint and provide a white portion 176.

In this case, the display station 26 is composed of transmissive liquid crystal and, since the undersurface of the scale plate 25 facing the surface thereof is provided with a white portion 176, the light of the exposure lamp of the exposure device 4 is allowed to transmit those other than the contents of display in the display station and reflect from the white portion 176 of the scale plate 25. Since white is similar to the ground color of the original data mounted on the document glass plate 2, those other than the contents of the display in the display station 26 are white, that is, the same as the ground color of the original data and accordingly no photographic fog of the copy image because the display station 26 ground color will not occur. Moreover, the distance from the exposure device 4 is seen to coincide with those according to the contents displayed by the display station 26 and the original data on the document glass plate 2, so that a clear copy image may be obtainable.

Since a buffer RAM is connected to the CPU, the contents of the display station may be registered on a card through the card reader 30, which is also used as a writing device.

Although the white portion coated with white paint and provided on the undersurface of the scale plate facing the display station has been indicated in the aforementioned embodiment, this arrangement is not limited to that white portion but may be prepared by sticking a white tape thereto or applying not white but any color paint having the sensitivity characteristics of the photosensitive drum, for instance, yellow color paint, which causes the ground color of the transmissive liquid crystal to have the characteristics equivalent to those inherent in white and prevents the photographic fog from being generated therein.

In this embodiment, superior effects are attributed to the fact that no photographic fog is generated in the image portion corresponding to the supplementary data even when the supplementary data together with the original data are copied and, because the distance from the exposure device agrees with that of the original data and the contents displayed, their focus points may be made to coincide with each other, thus making is possible to obtain a copy image of high quality.

Figure 18:
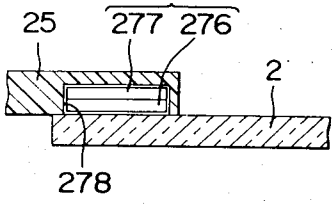
FIGS. 17, 18 are respectively enlarged views of display stations in another embodiment of the present invention.

In another embodiment of the present invention, the display station 26 comprises, as shown in FIG. 18, a transmissive liquid crystal portion 276 positioned on the surface of the document glass plate 2 and an EL (electrochromic sensor) 277, these being incorporated and arranged in a lower opening 278 of the scale plate 25.

In this case, the display station 26 comprises the transmissive liquid crystal portion 276 and the EL 277, which emits light because power is supplied to the EL 277 provided on the surface of the transmissive liquid crystal portion 276 whenever any display is made therein. Since an electric field is applied to the transmissive liquid crystal portion 276, portions other than those containing the contents of the display such as characters are made transparent. Since the light of the EL 277 thus actuated is allowed to transmit to the transmissive liquid crystal portion 276 and effect exposure, no photographic fog of the copy image caused by the ground color of the transmissive liquid crystal portion 276 is generated. Moreover, since the distance from the exposure device 4 agrees with those from the contents display in the display station 26 and the original data on the document glass plate 2, a clear copy image becomes available.

In this embodiment, no photographic fog of the image corresponding to the supplementary data occurs even when the supplementary data together with the original data are copied. Moreover, the use of the EL has made it possible to reduce the thickness of the display station and consequently prevent the platen cover from floating. As a result, superior effects are achievable as a copy image of good quality is obtainable.

Figure 19:
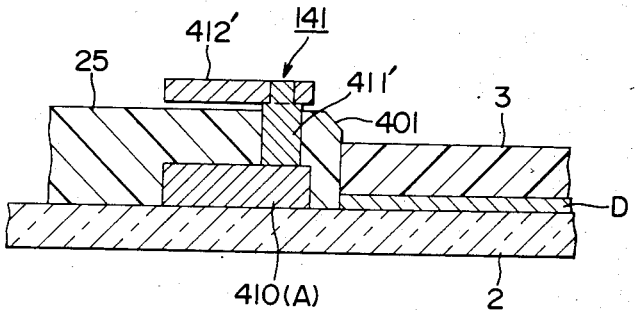
FIGS. 19(*a*), 19(*b*), 19(*c*), 20(*a*), 20() are respeotively views of document plates in still another embodiment of the present invention.
Figure 19:
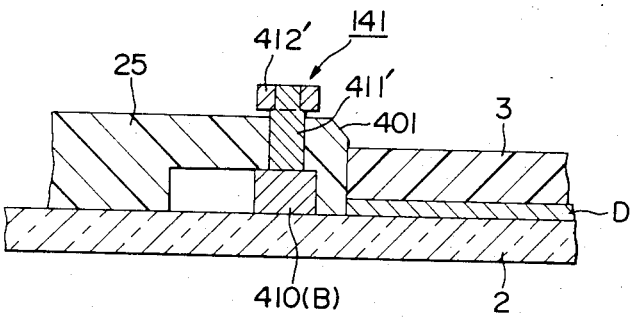
Figure 19:
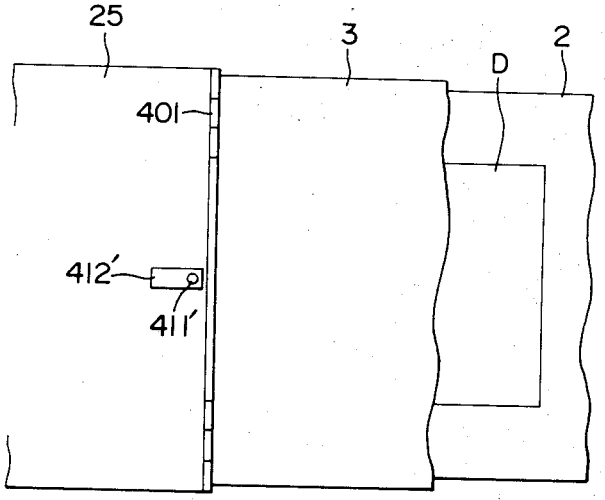

In another embodiment of the present invention, as shown in FIGS. 19(*a*)~19(*c*), a supplementary data recorder 141 is installed and made movable and opposite to the plate where an original is mounted at the central position close to the end face 401 of the scale of the scale plate 25. The supplementary data recorder 141 comprises an additional data recorder 410, a supporting shaft 411', and an operating lever 412' in combination wherein the operating lever 412' may be rotatably operated upwardly from outside the scale plate 25. As a result, the supplementary data are recorded vertically and horizontally against the recording paper.

Figure 20:
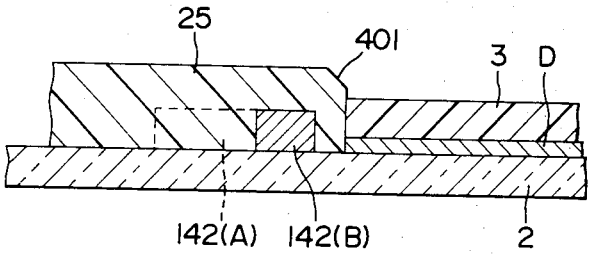
Figure 20:
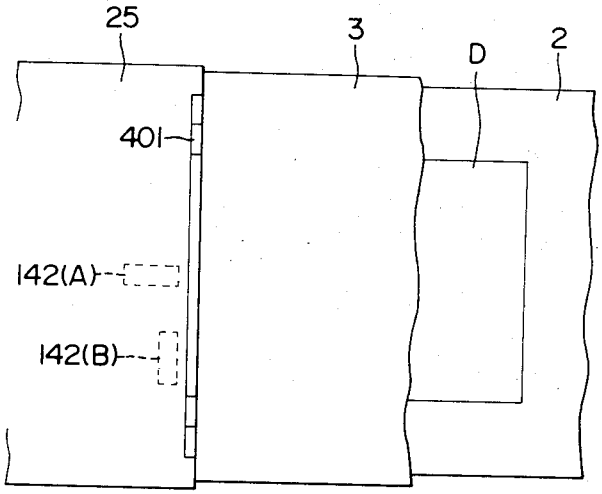

FIG. 20 shows still another embodiment of the present invention wherein two supplementary data recorders 142(A), 142(B) are vertically and horizontally fixed opposite to the plate where an original is mounted on the under surface of the scale plate 25 and wherein one of them is operated to recorded supplementary data such as dates.

Reflex liquid crystal is used for the supplementary data recording parts 410, 142(A), 142(B) in this embodiment, which comprises liquid crystal and a drive board. Although dates and numerals are indicated in seven segments in the display station, alphabets and katakana using the dot matrix may also be indicated.

A mode switching key (not shown) is installed in part of the character input key of the copying machine according to the present invention wherein the mode is capable of being switched over to one of the (1) modes for copying only the original data; (2-A) another for copying the original data and additional data (A) in the vertical position; and (2-B) the other for copying the original data and additional data (B) in the horizontal position. In the embodiment shown in FIG. 20, the additional data recorder 142(A) operates simultaneously when the mode is switched over to (2-A) and the additional data recorder 142(B) operates simultaneously when the mode is switched over to (2-B).

Figure 21:
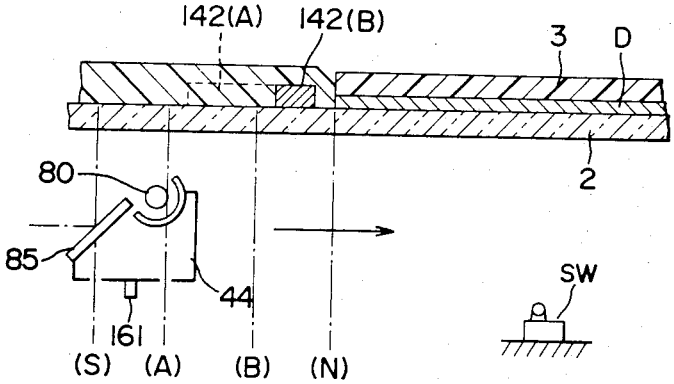
FIG. 21 is a view illustrating the principal portions of the document plate and optical scanner.
Figure 22A:
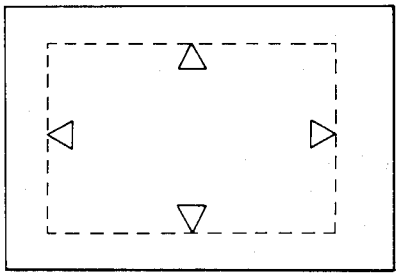
FIGS. 22(*a*), 22(*b*), 22(*c*), 22(*d*) are charts illustrating originals and three-mode copy picture images obtained therefrom.
Figure 22B:
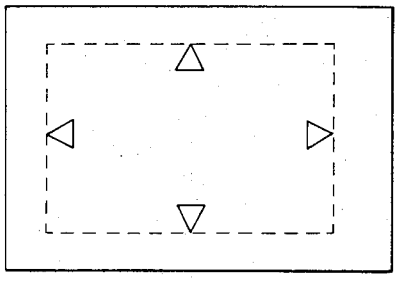
Figure 22C:
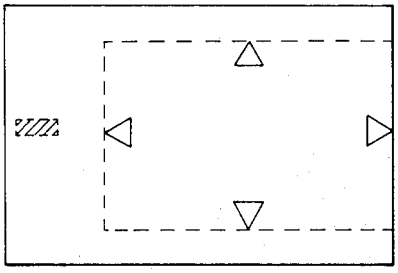
Figure 22D:
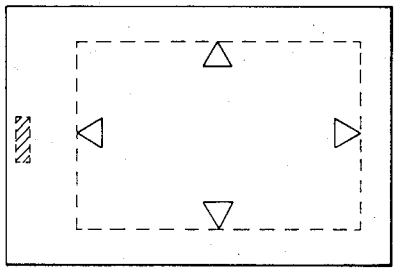

FIG. 21 shows that the first mirror unit is in such a position (S) as to be able to start optical scanning and the first mirror 44 will move to the right at a constant speed if the copy start button is pressed. In this embodiment, a dc motor drives the optical system and a paper feeding timing signal to be given to the paper feeding roller is given by the controller.

In the copying machine shown as the second embodiment, when the (2-A) mode is employed, the first mirror unit 44 moves to the right and a contact piece 161 with which the first mirror unit 44 is provided is used to turn on a newly installed microswitch and separately and scan the plate where the original is mounted up to its rear end. At the moment that it has been sensed that the microswitch has been turned on, the paper feeding rollers starts to operate and supply paper. The front end position of the recording paper to be supplied becomes synchronized with the original data including the additional data in the vertical position after the position (A) of FIG. 21.

When the (2-B) mode is subsequently used, the microswitch SW is turned on and the paper feeding rollers are started to supply paper by an encoder (not shown) synchronous with the photosensitive drum 5 after the passage of an SI pulse corresponding to the distance between the positions (A) and (B) of FIG. 21. The front end position of the recording paper thus supplied is synchronous with the original data including the additional data in the horizontal position after the position (B) of FIG. 21. The paper feeding rollers are started by the encoder so as to supply paper after the microswitch SW is turned on according to the mode (1) and the passage of an S2 pulse corresponding to the distance between the positions (A) and (N) of FIG. 21. The front end position of the recording paper thus supplied is synchronous with the original data after the position (N) of FIG. 21.

FIG. 22(*a*) shows an example of the original data and FIG. 22(*b*) a copy image of FIG. 22(*a*) obtained in the mode (1). FIG. 22(*c*) is a copy image of FIG. 22(*a*) obtained in the mode (2-A) wherein the supplementary data (indicated by slanted lines) in the vertical position by means of the supplementary data recording portion 410 or 142(A) is copied at the front end of the recording paper. FIG. 22(*d*) is a copy image of FIG. 22(*a*) obtained in the mode (2-B) wherein the supplementary data (indicated by slanted lines) in the horizontal position by means of the supplementary data recording portion 410 or 142(B).

As described above, the paper feeding timing varies according to the contents of the supplementary data in the vertical or horizontal position according to the present invention and, as is obvious from the comparison of FIGS. 22(*c*) and 22(*d*), the supplementary data is copied in a suitable place. The contents of the additional data not only means the vertical and horizontal positions of the supplementary data but are also determined relative to the image length of the supplemental data occupying on the recording paper.

In the present invention, as in the case of the foregoing embodiment, when the additional data 141 to be appropriated to the mode (2-A) is thus rotated in the vertical position, the detector portion (not shown) detects this position, whereby the paper feeding timing is accelerated to the maximum to allow the copy image to be formed as shown in FIG. 22(*c*) and FIG. 22(*a*). When the supplementary data 141 to be appropriated to the mode (2-B) is rotated in the horizontal position, the paper feeding is accelerated to allow the copy image to be formed as shown in FIG. 22(*d*). When the additional data is not copied, the original is copied as shown in FIG. 22(*b*) at the normal paper feeding timing.

In the embodiment described above, a dc motor has been used to drive the optical system. However, use is not limited to the dc motor and it is possible to employ other kinds of motors such as an induction motor capable of driving the optical system at uniform velocity. Moreover, although a microswitch for starting paper feeding operation has been used, an optical detector member or the like may also be used as a detector switch for starting the operation. Although the synchronous start according to the (2-B) mode or with the original data only equivalent to the mode (1) has been effected after Sl, S2 pulses by means of the encoder, a detection switch may be individually provided at each related position of the first mirror unit 44 to start the paper feeding rollers at the time of detection.

In another embodiment of the present invention, the encoder has been used to accelerate the start paper feeding by what is equivalent to the pulse S in the supplementary data recording mode against that of the original data only. The additional data is thus recorded without being stacked on the original.

In the embodiments described above, data which do not overlap are obtainable in the mode of copying supplementary data such as a data together with the original data. Accordingly, this makes it possible to obtain a copying machine capable of acquiring suitable images without unnecessary blanks on recording paper depending on the contents, for instance, the size of the additional data contained therein.

Another embodiment of the present invention will subsequently be described.

Figure 23:
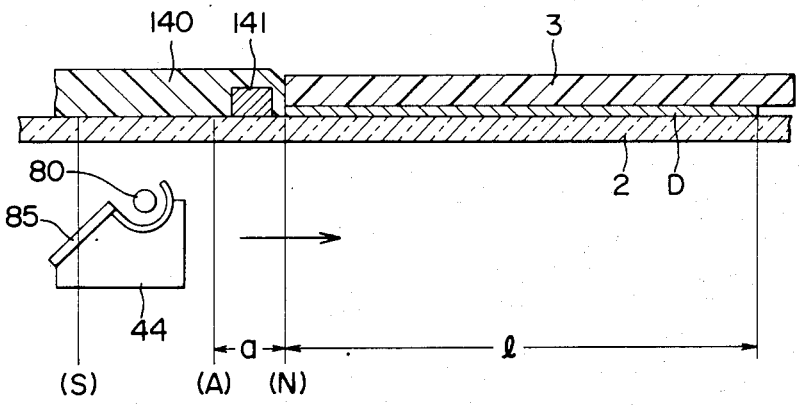
FIGS. 23 and 25 are views explanatory of document plates according to another embodiment of the present invention.
Figure 24A:
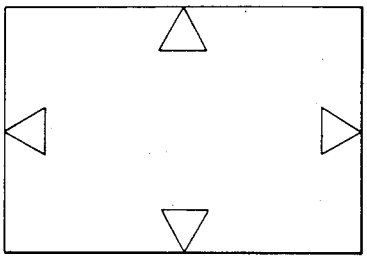
FIGS. 24(*a*), 24(*b*), 24(*c*), 24(*d*), 24(*e*), (24(*f*) are views explanatory of documents and copy picture images obtained therefrom.
Figure 24B:
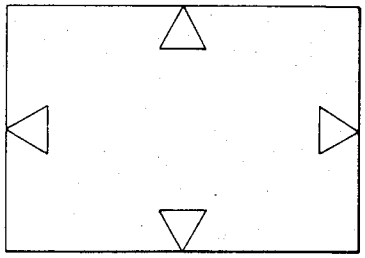
Figure 24C:
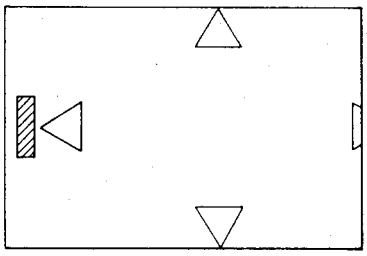
Figure 24D:
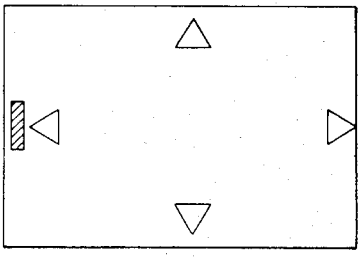
Figure 24E:
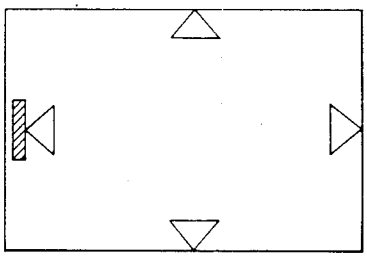
Figure 24F:
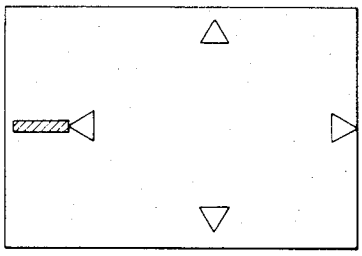

FIG. 23 shows a state wherein the first mirror unit 44 is at the position (S) where optical scanning is started and the first mirror unit 44 moves to the right at a constant speed by pressing the copy start button. To make a copy of the original data only, the image after the position (N) has been synchronized with the front end position of the recording paper fed by starting the second paper feeding rollers. To make a copy of additional data together with the original data, the image including the additional data after the position (A) is required to synchronize with the front end position of the recording paper fed by starting the second paper feeding rollers.

FIG. 24(*b*) is a case where the original data of FIG. 24(*a*) has been copied. FIG. 24(*c*) shows another where the additional data together with the original data has been copied at the front position, the additional data being shown by slant lines. As is obvious from the drawing, the final portion of the original data is not copied when the whole area is used for the original data against the original size. Accordingly, it is so controlled according to the present invention that, when additional data together with the original data is copied without piling the former on the latter, both the data are scaled down and copied.

The magnification m when scale-down copying is carried out, $$m = l/(l+a)$$

will be appropriate, where l: length of the original in the optical scanning direction; and a: length of additional data. However, because it is inconvenient to manually change m to comply with the original size each time, m should be set at approximately 0.96~0.98. It is preferable to have m changed automatically.

To effect copying with the above magnification, an image having a magnification of m should be arranged to be formed on the photosensitive drum 5 through the optical system by (i) moving the lens position after changing the focal length of the lens 24, (ii) moving the lens 24 and the second mirror unit 23 and (iii) moving the second mirror unit 23 after changing the focal length of the main lens. A zoom lens is used as the main lens or an attachment lens is added to change the focal length of the main lens. Moreover, a pulse motor is used as a means for moving the optical unit to a position with a magnification of m. A home position sensor is installed to move the optical unit to the position with a magnification of m by controlling the motor with the number of pulses therefrom.

For the optical unit, the scanning speed of the first mirror unit 44 is changed to 1/m by moving the photosensitive drum 5 to its initial position with the projection magnification thereon being set at m times. FIG. 24(*d*) shows the copy image thus obtained, solving the problem caused by the absence of part of the original data on inserting the supplementary data.

The copy image shown in FIG. 24(*d*) has been reduced m times in both the vertical and horizontal directions. However, it is possible to drive the first mirror unit 44 by reducing its scanning speed to 1/m without changing/moving the optical system for a reduction.

In this case, as shown in FIG. 24(*e*), the additional data together with the original data with nothing deleted is copied, though a shear is generated in the copy image. Such a shear in copying causes almost no problem with the original data mainly constituted by character codes.

In the description of the copying machine according to the present invention, although reference has been made to supplementary data as being recorded verbatim, it follows that the supplementary data may be selected, provided that the supplementary data recorder 141 is rotatable or otherwise that the contents of the additional data being recorded are electrically varaible. In these cases, the length of the additional data in the direction where optical scanning is effected changes. It is necessary to scale down the magnification m to a different value then depending on the given condition. The greater a, the smaller the magnification m. FIG. 24(*f*) shows a copy image obtained by changing the supplementary data from the horizontal to the vertical position and increasing a.

Figure 25:
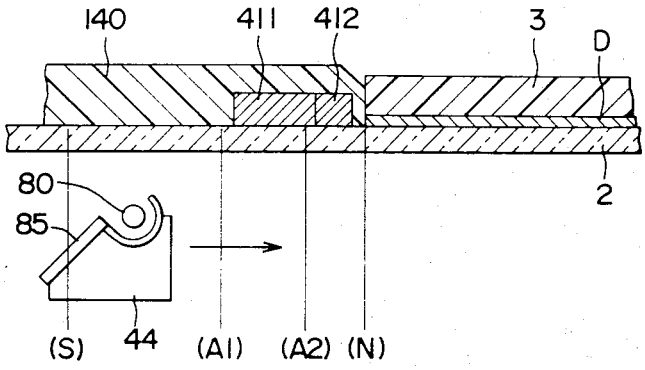

FIG. 25 illustrates that case wherein there are installed two supplementary recorders 411, 412 on the surface of the plate 2 for mounting the original in the undersurface of the scale plate 140. When the additional data of the supplementary data recorder 411 is recorded, it is so controlled that an image including supplementary data after the position (Al) is copied with a magnification of ml and the front end and made synchronous with the front end position of the recording paper fed by starting the second paper feeding roller.

When the supplementary data recording operation is switched over to the supplementary data recorder 412, an image including supplementary data after the position (A2) is copied with a magnification of m2 and made synchronous with the front end position of the recording paper.

The omission of the final end of the original is thus prevented. Here it is assumed that $ml<m2<1$.

In the above-described embodiments, a reflex liquid crystal has been used for the supplementary data recorder 141. However, one with a light source arranged on the back of transmissive liquid crystal, an ECD (electrochromic display) or the like may also be used.

According to the present invention, additional data together with the original data are copied without overlapping each other and all these data without omission are copied on recording paper.

What is claimed is:

1. An original picture image recorder comprising a supplementary data display means for displaying supplemental data being copied in addition to original data, said display means being provided close to a document glass plate on which documents being recorded are mounted; an image forming assembly for exposing said documents and display means to light and forming electrostatic images corresponding to reflex light therefrom on an image retainer; a developing assembly for developing the electrostatic images into visible ones; and means for preventing the background area of said display means in a display state from generating photographic fog on materials being recorded.

2. An original picture image recorder as claimed in claim 1, wherein a light source for illuminating said display means as one for preventing photographic fog is provided separately from an original exposure means for exposing said display means.

3. An original picture image recorder as claimed in claim 1, wherein said display means is composed of transmissive liquid crystal and planar type light source is provided facing the back thereof as a means for preventing photographic fog.

4. An original picture image recorder as claimed in claim 1, wherein an unwanted charge eliminating means is provided as a means for preventing photographic fog on the image retainer on which an electrostatic image corresponding to the additional data of said display means is provided.

5. An original picture image recorder as claimed in claim 4, wherein said unwanted charge eliminating means is an exposure means.

6. In an image forming method comprising exposing a document on a document glass plate, displaying additional information on an additional display means in the vicinity of said document glass plate to form electrostatic latent images on an image retainer, and developing said electrostatic latent images to obtain toner images, the improvement which comprises exposing said document with a different degree of exposure from the exposure of said additional information.

7. The image forming method of claim 6 wherein the exposure of said additional information is greater than that of said document.

8. In an image forming method comprising exposing a document on a document glass plate, displaying additional information on an additional information display means in the vicinity of said document glass plate to form electrostatic latent images on an image retainer, and developing said electrostatic latent images to obtain toner images, the improvement which comprises applying a developing bias voltage to said developing means, there being different bias voltages applied to electrostatic latent image regions on the image retainer corresponding to said additional information and said document.

9. The image forming method of claim 8, wherein the bias voltage applied to said developing means when a region corresponding to said additional information is developed is larger than that when a region corresponding to said information of the document is developed.

* * * * *